US006211117B1

(12) United States Patent
Haggerty et al.

(10) Patent No.: US 6,211,117 B1
(45) Date of Patent: Apr. 3, 2001

(54) PRINTING PLASTICS SUBSTRATES

(75) Inventors: John Nicholas Haggerty; Timothy Mathias, both of Plymouth; Dominic Roger Meech, Bristol, all of (GB)

(73) Assignee: Spirent plc, West Sussex (GB)

( * ) Notice: Subject to any disclaimer, the term of this patent is extended or adjusted under 35 U.S.C. 154(b) by 0 days.

(21) Appl. No.: 09/228,386

(22) Filed: Jan. 12, 1999

Related U.S. Application Data

(63) Continuation-in-part of application No. 08/989,061, filed on Dec. 11, 1997, now abandoned.

(30) Foreign Application Priority Data

| | | |
|---|---|---|
| Dec. 11, 1996 | (GB) | 9625705 |
| Nov. 26, 1997 | (GB) | 9724862 |
| Apr. 7, 1998 | (GB) | 9807436 |

(51) Int. Cl.[7] ..... B41M 5/035; B41M 5/38

(52) U.S. Cl. ..... 503/227; 346/76.1; 428/36.9; 428/131; 428/195

(58) Field of Search ..... 8/471; 428/195, 428/913, 914, 34.1, 35.7, 36.9, 131; 503/227; 346/76.1

(56) References Cited

U.S. PATENT DOCUMENTS

| | | | | |
|---|---|---|---|---|
| 4,572,684 | | 2/1986 | Sato et al. | 400/240.4 |
| 4,636,271 | | 1/1987 | Gandolfo | 156/73.1 |
| 4,661,393 | | 4/1987 | Uchiyama et al. | 428/200 |
| 4,720,480 | * | 1/1988 | Ito et al. | 503/227 |
| 4,784,905 | | 11/1988 | Suzuki et al. | 428/195 |
| 4,900,174 | | 2/1990 | Didiergeorge | 400/621 |
| 5,064,807 | * | 11/1991 | Yoshida et al. | 503/227 |
| 5,184,152 | | 2/1993 | French | 346/76 PH |
| 5,215,383 | | 6/1993 | Hilton | 400/621 |
| 5,276,459 | | 1/1994 | Danzuka et al. | 346/33 A |
| 5,538,831 | * | 7/1996 | Oshima et al. | 503/227 |
| 5,620,508 | | 4/1997 | Yamano et al. | 106/23 A |
| 5,676,478 | | 10/1997 | Bowman et al. | 400/621 |
| 5,766,705 | | 6/1998 | O'Brien et al. | 428/34.9 |

FOREIGN PATENT DOCUMENTS

| | | |
|---|---|---|
| 0365222 A2 | 10/1989 | (EP) . |
| 0 365 222 A2 | 4/1990 | (EP) . |
| 0780238A2 | 6/1997 | (EP) . |
| 2083726A | 9/1981 | (GB) . |
| WO96/10489 | 4/1996 | (WO) . |
| WO99/11466 | 3/1999 | (WO) . |

OTHER PUBLICATIONS

IBM Technical Disclosure Bulletin, vol. 18,. No. 10 Mar. 1976 discloses thermally sensitive ribbon for laser transfer printing.

* cited by examiner

*Primary Examiner*—Bruce H. Hess
(74) *Attorney, Agent, or Firm*—David P. Gordon; David S. Jacobson; Thomas A Gallagher

(57) ABSTRACT

Printed markers for identifying electrical cables are formed by winding an elongate plastics strip or flattened length of plastics tubing 19 onto a reel 30, which is then mounted for rotation to a thermal transfer printer 25. The printer then prints markings 14 onto the strip or tubing 19 as it advances past a print head 36 of the printer 25. The strip or tubing 19 may be formed with transverse lines of weakness at intervals along its length, to define successive markers. The thermal transfer printer 25 comprises a transfer ribbon 38 carrying a releasable printing composition, which print composition comprises a first pigmentation material capable of penetrating into the plastics of the strip or tubing 19, and a second pigmentation material capable of adhering to the surface of the plastics of the strip or tubing 19.

20 Claims, 5 Drawing Sheets

PRINTING PLASTICS SUBSTRATES

This application is a continuation-in-part, filed Dec. 11, 1997, of application Ser. No. 08/989,061, now abandoned.

BACKGROUND OF THE INVENTION

The present invention relates to printing plastics substrates and in particular to printing plastics substrates, such as markers for identifying electric cables etc., using a thermal transfer printing process.

U.S. Pat. No. 5,676,478 discloses a printer for printing plastics tubular markers for applying to individual cables. These plastics tubular markers may be heatshrinkable or non-heatshrinkable. The printer comprises a thermal print head having an array of pixels, each of which can be thermally activated, in order to melt the surface of the plastics tubular markers and to form a corresponding image thereon. This process is slow because the plastics tubular markers have to be advanced sufficiently slowly for and image to be formed. The process is also unreliable, because the print head is liable to become clogged with melted plastics material.

It is known to print onto plastics by applying pressure and heat to a printing ribbon registering against the plastics material, such that a print composition carried by the ribbon is transferred to the material. Conventionally, thermal transfer ribbons rely upon a wax or resin to transfer the dry ink onto the feedstock substrate.

This method of printing has inherent drawbacks; for example, the ink can be removed by means of heat, chemical action or abrasion. This can result in important printed images becoming unreadable. Furthermore, over time, the action of ultra violet radiation on pigments in the ink can result in the image fading.

SUMMARY OF THE INVENTION

We have now devised arrangements which offer significant advantages relative to the arrangements which have been provided hitherto.

In accordance with this invention as seen from a first aspect, there is provided a method of printing onto a plastics substrate, the method comprising applying heat and pressure to a print carrier registering against the substrate resulting in transfer of a printing composition carried by the print carrier to the substrate, the printing composition comprising a first pigmentation material arranged to penetrate into the plastics substrate to form a substantially permanent mark below the surface of the substrate, and a second pigmentation material arranged to adhere to the surface of the substrate overlaying the substantially permanent mark.

The invention enables a single stage printing process to be used to print a marking of predetermined configuration onto a plastics substrate, the marking comprising a sub-surface marking and corresponding surface printed marking. The dual nature of the marking provides advantages in terms of durability, particularly for use in harsh environments, or situations where the mark is liable to be subject to chemical action, or abrasion in the normal course of events or in cases of unauthorized tampering.

The invention is particularly suitable for use in providing plastics printed markers for identifying articles.

Thus, preferably the method comprises advancing a length of elongate plastics strip or flattened tubing longitudinally of itself past the print carrier and printing indicia at successive longitudinal intervals onto said plastics strip or tubing.

The plastics strip or tubing may be formed with transverse lines of weakness after it has been printed.

Also, in accordance with this invention as seen from a second aspect, there is provided a thermal transfer printer in combination with a plastics substrate, the printer having a thermal transfer print head and a print carrier carrying a releasable printing composition, which print composition comprises a first pigmentation material capable of penetrating into said plastics substrate, and a second pigmentation material capable of adhering to the surface of said plastics substrate.

The printing composition carried by the print carrier comprises the first and second pigmentation materials and also, preferably, a plastics material facilitating penetration into the substrate.

In one embodiment, the plastics material of said printing composition may be the same as the plastics material of the plastics substrate.

In an alternative embodiment, the plastics material of said printing composition may be different from the plastics material of the plastics substrate. In this instance, the plastics material transferred from the print carrier and penetrated into the substrate will be identifiable in the resulting printed marker, at least upon microscopic inspection.

It is preferred that the plastics material of said printing composition comprises a thermoplastic material, such as PVC, a polyolefin or the like, more preferably, a homopolymer material.

It is preferred that the print carrier comprises a plastics film (desirably comprising polyester) preferably of a thickness substantially in the range 4–15 microns, more preferably approximately 6 microns. The print carrier is capable of separating from the print composition it carries during the thermal transfer printing process. Desirably the print carrier is wound from a reel store.

The print composition (or ink) carried by the print carrier is preferably touch dry. The first and second pigmentation materials are preferably relatively dark in color and may for example be blue or black. The pigmentation materials may for example comprise dyes of suitable composition to ensure that one penetrates the substrate and the other adheres to the surface of the substrate during the printing process.

One or other (or both) of the first and second pigmentation materials may comprise a mixture or composition of a plurality of dyes.

It is preferred that the printing composition comprises the pigmentation materials and the plastics material bound in a matrix material. The printing composition is preferably applied to the print carrier as a layer. The matrix material may, for example, comprise a relatively soft, high molecular weight material such as a wax or wax-like material.

The thermal transfer printer may be arranged to print any predetermined indicia mark upon the substrate.

Preferably the plastics substrate comprises an elongate length of plastics strip or tubing, which is preferably preformed with transverse lines of weakness at intervals along its length, to define successive markers. The lines of weakness may be provided by a line of perforations or by a partial cut through the thickness of the plastics material: however, the lines of weakness may be formed at any desired intervals, so forming markers of any desired lengths.

Preferably, the plastics strip is semi-rigid. Preferably, the plastics strip comprises an adhesive backing.

In use, as the plastics strip or tubing advances through the printer, the position of the perforations or lines of weakness between successive markers needs to be determined, so that the printer can determine where to position each successive print on each successive marker.

Thus, preferably datum markings are formed at regular intervals along the plastics strip or tubing, the spacing between each marking being related to the length of each marker, the printer comprising a sensor arranged to sense the position of each marker as the plastics strip or tubing is advanced through the printer and control means arranged to control the position at which successive prints are formed on successive markers of the plastics strip or tubing, in accordance with the output of the sensor.

In use, the sensor detects the position of the datum markings, so that the printer knows when it can start printing each successive marker.

Preferably a datum marking is provided on each of the successive markers. However, it is envisaged that datum markings may not be provided on every marker, in which case the printer is preferably arranged to calculate the position at which each successive marker is to be printed.

Preferably the markings are transparent and thus do not affect the appearance of the markers on which they are provided.

Preferably the markings are formed of a UV reflective material such as ink.

Preferably, the printer comprises a UV light source which irradiates the strip or tubing, the sensor being arranged to detect said UV light reflected from the datum markings.

A disadvantage of cutting or tearing markers from a length of markers is that the length of markers becomes fragmented, with the result that some markers can become lost. This is a particular problem where is each marker is printed differently and selected markers are then cut at random from the length.

In order to overcome this problem, the plastics strip or tubing is preferably joined to an axially extending carrier which keeps the remaining markers together once markers have been cut or torn from the length.

In one embodiment, the edge of the plastics strip or tubing is connected to the edge of the carrier. Preferably, two lengths of plastics strip or tubing are mounted side-by-side to respective opposite side edges of the carrier. Preferably, the or each length of plastics strip or tubing is frangibly connected to the carrier.

In an alternative embodiment, the plastics strip or tubing is mounted on an elongate carrier of sheet material such as paper, the strip or tubing being disposed between opposite side edges of the carrier. Preferably, a plurality of strips and lengths of tubing co-extend along the carrier: This format aids alignment, since the carrier can be tractor-fed, say by means of perforations extending along the length of the carrier.

Preferably the printer is arranged to receive a wound length of strip or tubing of selected width. Preferably the printer is arranged to receive two or more wound lengths of strip or tubing, side-by-side.

Preferably the printer comprises means for guiding the strip or tubing past the print head, the guiding means being arranged to constrain the strip or tubing against lateral displacement as it advances through the print head.

The guiding means preferably comprises a pair of elongate guides which extend from the reel towards the print head, the elongate guides having inwardly-facing edges which are formed with longitudinal grooves in which the opposite edges of the strip or tubing are slidably received. These elongate guides may comprise two separate members which can be engaged, either side of the reel, onto a spindle on which the reel is fitted. Instead, the elongate guides may be mounted to the reel, so that the reel and guides form a single unit for fitting into the printer. The strip or tubing may be printed on one side, and rewound onto the same or different reel, which is inserted into the printer for printing onto the opposite side of the strip or tubing.

Yet further in accordance with the present invention, there is provided a series of plastics printed markers, each comprising a plastics substrate having a printed mark, the printed mark comprising:

a) a first, sub-surface portion of a first pigmentation material penetrated into the substrate, and;

b) a second, surface portion of a second pigmentation material adhered to the surface of the substrate overlaying the sub-surface portion of the mark.

Preferably, the plastics substrate comprises an elongate length of strip or flattened tubing, said strip or tubing preferably being formed with transverse lines of weakness at intervals and carrying printed marks between the adjacent pairs of lines of weakness.

The strip or tubing may be wound onto a reel. Alternatively, the elongate strip or tubing may be wound within a cassette, having an exit slot through which the feedstock passes. In this case, preferably the cassette includes a portion which projects radially outwardly and includes the exit slot at its outer end, so that opposite side walls of this projecting portion constrain the strip or tubing against transverse displacement as it advances towards the print head.

Preferably the cassette is arranged so that it can be reversed, to enable the strip or tubing to be printed on either side: in particular, the strip or tubing can be printed on one side, then rewound into the cassette, for the cassette then to be turned over to enable printing on the opposite side of the strip or tubing. Preferably therefore, the cassette is symmetrical about a plane which contains its exit slot and the axis around which the strip or tubing is wound.

BRIEF DESCRIPTION OF THE DRAWINGS

Embodiments of the present invention will now be described by way examples only and with reference to the accompanying drawings, in which.

DESCRIPTION OF THE PREFERRED EMBODIMENTS

Figure 1:
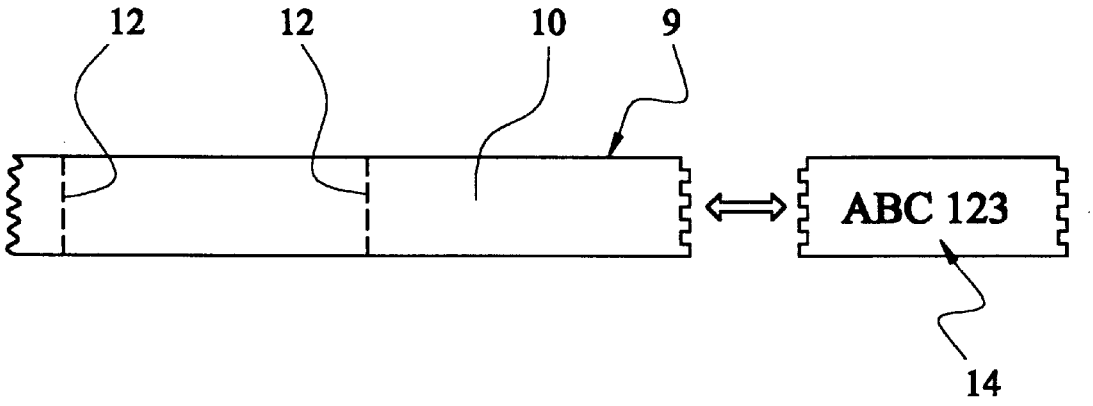
FIG. 1 is a plan view of a first embodiment of printed cable marker in accordance with this invention.

Referring to FIG. 1 of the drawings, there is shown a portion of a length of tubing 19 which has been flattened by being passed between a pair of rollers under moderate heat. The tubing substrate 19 may be heatshrinkable or non-heatshrinkable, and comprises a plastics material e.g. PVC or a polyolefin. The tubing 19 is semi-severed across its width at periodic intervals, as indicated at 12, so that individual markers 10, once printed with indicia 14, can be torn from it, as shown.

Figure 2:
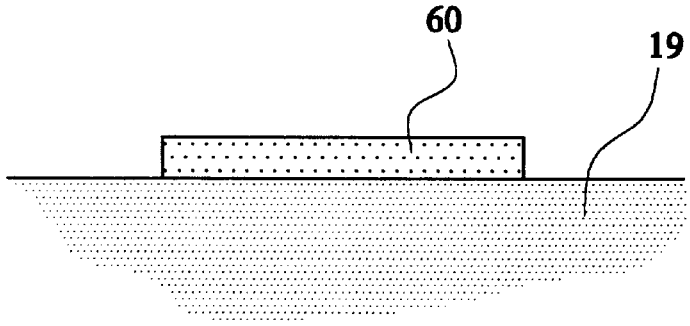
FIG. 2 is a schematic sectional view of a prior art printed cable marker.

Referring to FIG. 2 of the drawings, when applying conventional thermal transfer printing techniques, a layer of printed ink 60 adheres to the surface of tubing 19. It is possible intentionally, or accidentally, to remove the printed ink layer I from the underlying plastics tubing substrate 19 by abrasion, chemical action or degradation due to exposure to ultra-violet radiation.

Figure 3:
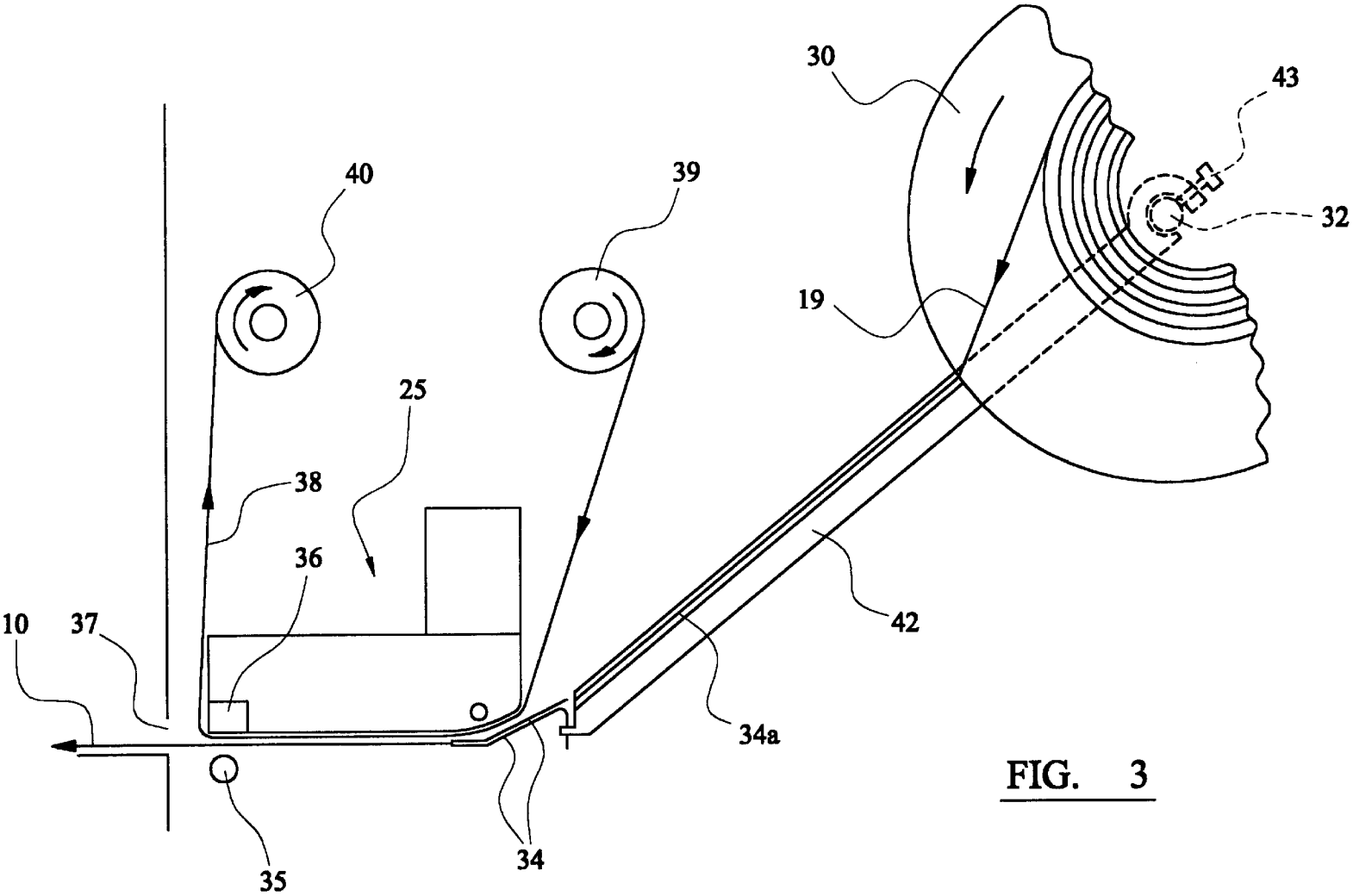
FIG. 3 is a schematic side view of an embodiment of thermal transfer printer in accordance with this invention.

Referring to FIG. 3 of the drawings, there is shown an apparatus 25 for printing the tubing substrate 19 in accordance with the present invention. The apparatus 25 comprises a drive roller 35 which draws flattened feedstock tubing 19 from a reel store 30, to extend past a thermal printing head 36 of the apparatus. In order to prevent the flattened feedstock tubing 19 wandering sideways as it passes from its reel 30 to the print head 36, a guide arrangement is provided, comprising a pair of elongate guide members 42. At one end, the guide members 42 engage over the spindle 32 either side of the reel 30 and are secured in position by tightening respect screws 43: at their opposite ends, the guide members 42 engage in a slot 34*a* in a downwardly-bent rear portion of the lower guide plate 34.

As the flattened feedstock tubing 19 is drawn past the printing head 36, a printer ribbon 38 is simultaneously fed from a store of unused ribbon 39 extending past printing head 36, the printer ribbon 38 subsequently being wound onto reel 40. In use, the printing head 36 is urged to press against the flattened feedstock tubing 19, thereby sandwiching the printer ribbon 38 therebetween such that printer ribbon 38 is held in register with the feedstock tubing 19. In this way, the relevant indicia are marked on the tubing 19 as the print composition carried by the printer ribbon 38 is transferred to the surface of the flattened tubing 19.

The printer ribbon 38 comprises a polyester backing film between 4–15 microns in thickness (preferably approximately 6 microns in thickness), and which is arranged to release the printing composition under the applied pressure and heat of the thermal printer head 36. The print composition carried by the printer ribbon 38 is dry to the touch and comprises first and second selected coloration materials (such as respective dyes) and a thermoplastic material compatible with the material of the tubing 19 carried in a suitable matrix material, such as wax.

Figure 4:
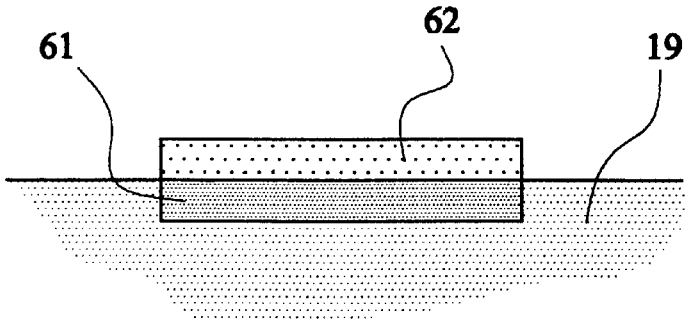
FIG. 4 is a schematic sectional view through the cable marker of FIG. 1.

One of the coloration materials, and also the thermoplastic material, are selected to penetrate into the plastics material of the tubing substrate (for example by diffusion), upon application of the thermal transfer printing head 36. In this way, as shown in FIG. 4, a substantially indelible mark 61 in the required configuration of the indicia is formed at, or more preferably below, the surface of the substrate material 19. The other of the coloration materials is selected to be printable on the surface of the plastics tubing substrate 19, and not to penetrate significantly below the substrate surface. This provides a surface printed mark 62 overlaying the subsurface mark 61.

A suitable printing composition and matrix for performance of the invention has been found to be as follows:

i) 50–70% by weight, first and second coloration materials. The first pigmentation material comprises a first dye (a solvent violet) based on N—tetra, N—penta, N—Lisea para-rosaniline hydrochlorides and a second dye (a solvent black) being an azo dye of formula $C_{29}H_{24}N_6$ chemical name 1 H-pyrimidine, 2,3-dihydro-2,2-dimethyl-6[(4-)phenylazo)-1-naphthyl) azo]. The second coloration material comprises an amorphous black inert solid such as furnace black.

ii) 8–12% by weight low molecular weight homopolymer PVC.

iii) 15–20% by weight, releasing agent comprising a wax (stearic acid).

The constituents of the printing composition are milled together; the combined material is then layered onto the polyester film.

In use, the first coloration material binds with the PVC nomo polymer material and penetrates the material of the plastics tube 19 to provide the subsurface mark 61. The second coloration material provides the surface printed mark 62 overlaying the subsurface mark 61.

Figure 5:
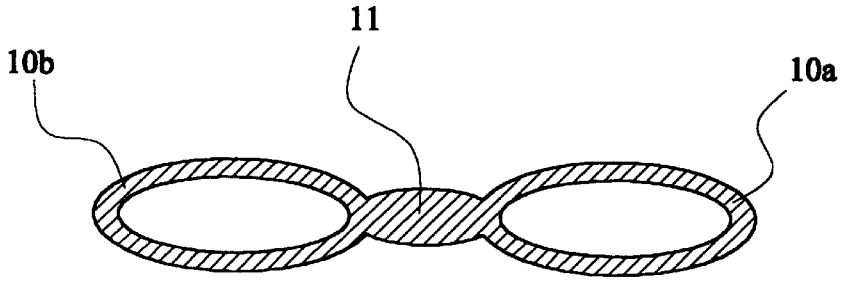
FIG. 5 is sectional view through a second embodiment of printed cable marker in accordance with this invention.
Figure 6:
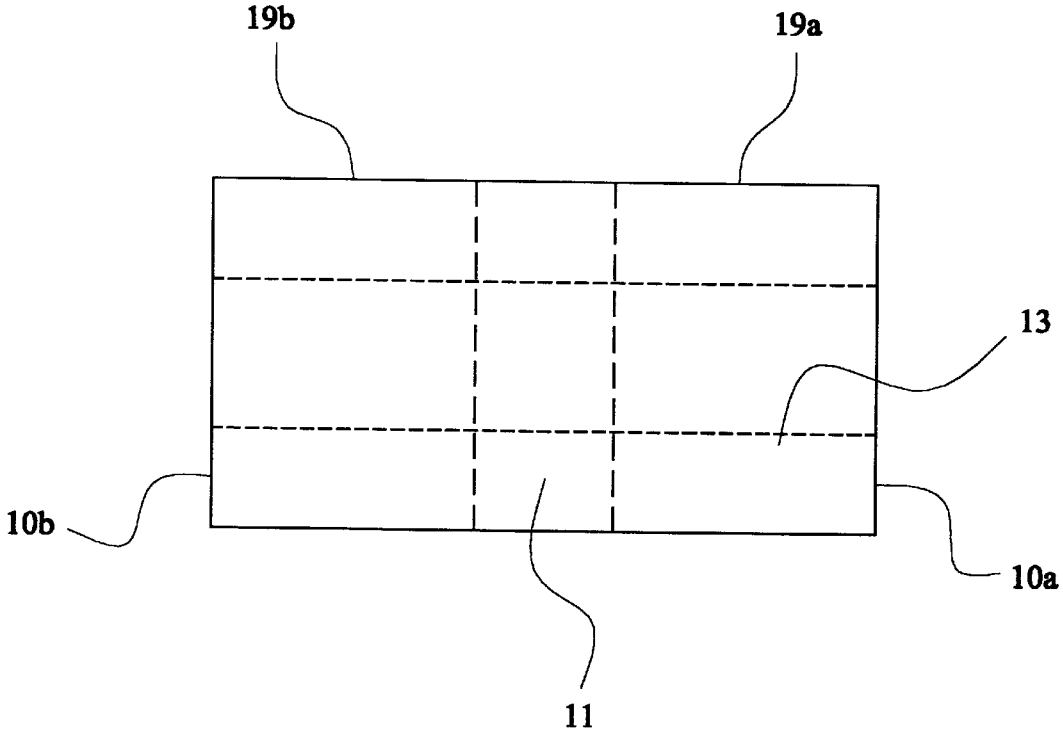
FIG. 6 is a plan view of the printed cable marker of FIG. 5.

Referring to FIGS. 5 and 6 of the drawings, two lengths of flattened tubing 19*a*,19*b* are arranged side-by-side and are interconnected by a solid carrier 11. The lengths of tubing 19*a*,19*b* can be printed simultaneously using a single printer.

Once printed, the lengths of tubing 19*a*,19*b* can be detached from the carrier 11 using a simple tearing action. Both lengths of tubing 19*a*,19*b* are semi-severed across their width at periodic intervals, as indicated at 13, so that selected individual markers 10*a*,10*b* can be detached from various points along the printed length: the carrier 11 keeps the remaining portions of the tubing 19*a*,19*b* together, so that they do not get lost and so that further individual markers can easily be selected.

Figure 7:
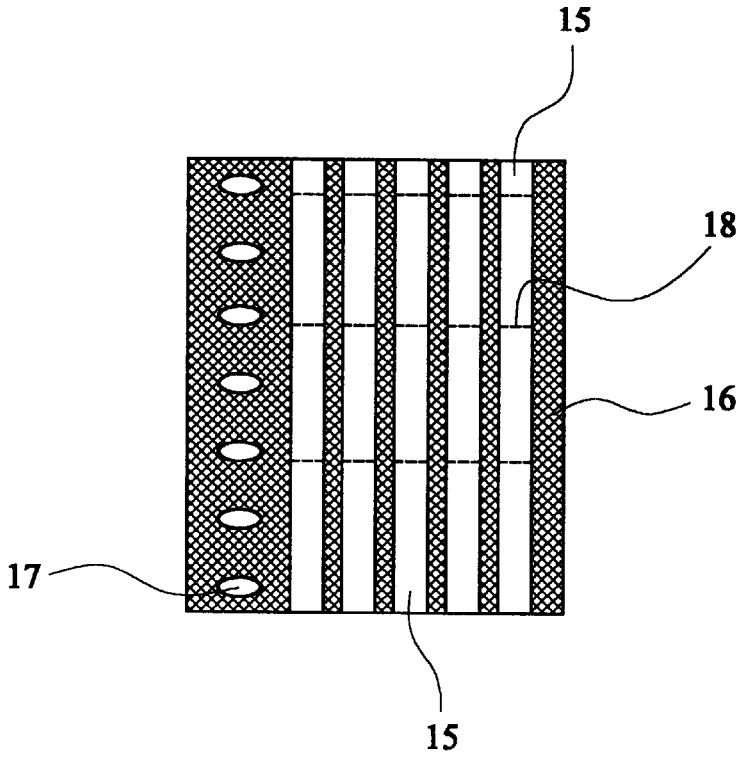
FIG. 7 is a plan view of a third embodiment or printed cable marker in accordance with this invention.

Referring to FIG. 7 of the drawings, one or more lengths of strip and/or tubing 15 can be supplied adhered to a paper carrier 16 and presented on a roll. The carrier 16 comprises a longitudinally extending series of perforations 17 which can be engaged by a toothed drive wheel on the printer, so as to advance the carrier and strip or tubing through the printer. The lengths of strip or tubing are severed across their width, as indicated at 18, so that individual printed markers can be selected at random from the carrier 16, whilst keeping the remaining markers conveniently together.

Figure 8:
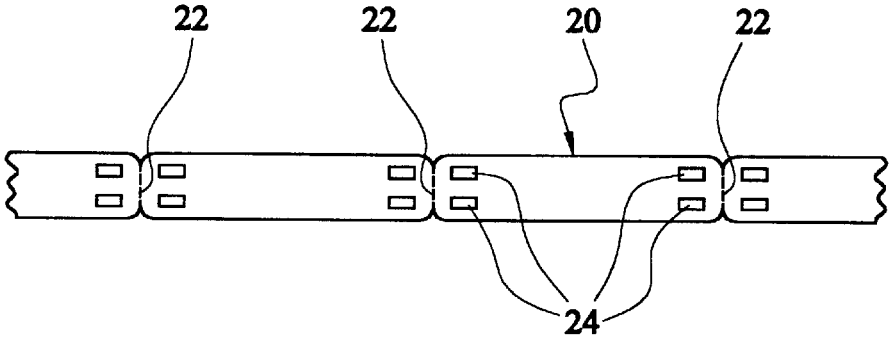
FIG. 8 a plan view of a fourth embodiment of printed cable marker in accordance with this invention.

FIG. 8 shows a portion of a length of flat strip 20 which is also semi-severed at intervals along its length, as indicated at 22, to define successive markers. The strip is pre-punched to form each such marker with a pair of rectangular apertures 24 (or alternatively with a single aperture) adjacent each of its opposite ends, for attaching the marker, typically using cable ties, to a cable etc. to be marked.

It will be appreciated that feedstock of any of the types shown in FIGS. 5 to 8 may be wound onto a reel 30, which is then filled into a thermal transfer printer of the type shown in FIG. 3.

Figure 9:
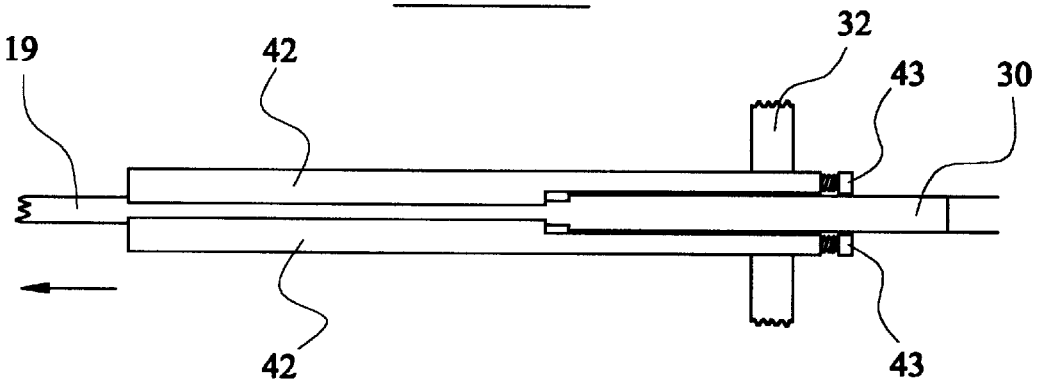
FIG. 9 is a plan view of a guide arrangement of the printer of FIG. 3.

Referring to FIG. 9 of the drawings, the printer 25 comprises a spindle 32 projecting from a side wall of the apparatus, and the reel 30 is received on this spindle. The feedstock 19 then passes from the reel 30, through the closely-spaced guide plates 34. A gap is provided between the two guide members 42: the inwardly facing edges of the two guide members 42 are formed with longitudinally-extending grooves (one of which is shown at 42*a* in FIG. 3). The opposite edges of the feedstock 19 are received in the longitudinal grooves 42*a* of the two guide members 42.

In the example shown in FIG. 9, the two guide members 42 are separate from the reel 30 and independently fitted in place, at one end in the slot 34*a* of the lower guide plate 34 of the printer 25 and at the other end on the spindle 32. Instead, the two guide members 42 may be mounted to the reel 30, enabling the reel and guide members to be fitted as a single unit into the printer 25: for example, the two guide members 42 may fit together through the center opening in the reel.

Two or more reels 30, with their respective guide members, may be mounted side-by-side on the spindle 32, such that their feedstock advance side-by-side past the print head 36. In this way, the corresponding number of feedstock (tubes or strip) may be printed simultaneously.

The feedstock used in the printer may be of a wide range of different widths, the reel 30 being of corresponding width. Where the feedstock is preformed with transverse lines of weakness at regular intervals along its length, then use is made of a graduated support projecting from the front of the printer 25: thus, the feedstock is pulled through until its leading end is aligned with one of the graduations, appropriate for the distance between the successive lines of weakness of that particular feedstock; this ensures that the printing process will be synchronized to the successive markers.

The feedstock may be formed to a profile in cross-section, instead of being flat. In this case, the guide plates 34 and roller 36 of the printer 25 may be formed with a correspondingly profiled cross-section.

Figure 10:
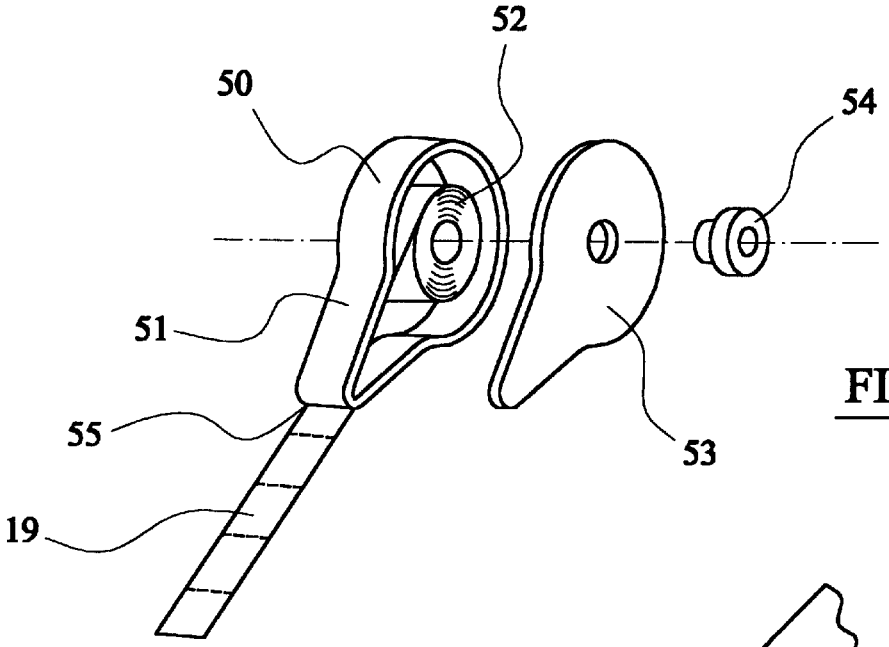
FIG. 10 is a view of a cassette of printed cable markers in accordance with this invention.
Figure 11:
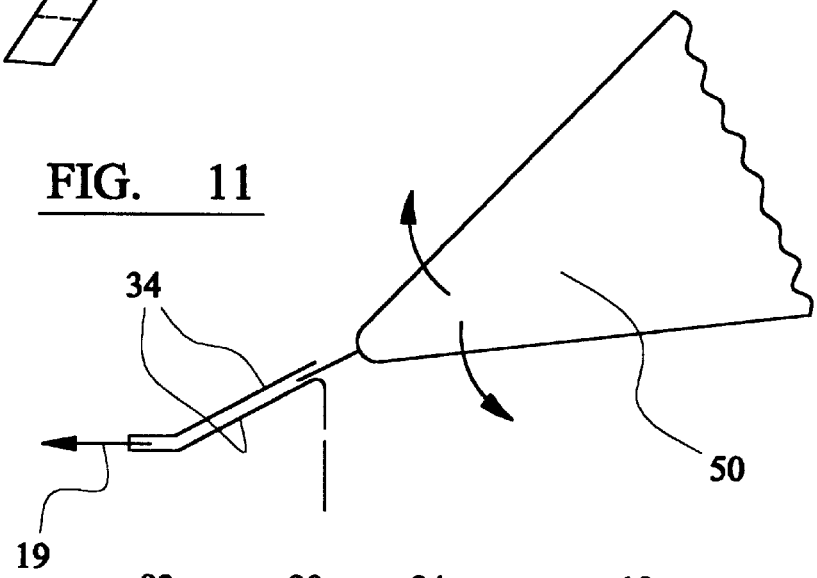
FIG. 11 is a view of the cassette of FIG. 10 fitted into the thermal transfer printer of FIG. 3.

Instead of being wound on a reel, the feedstock may be wound into a cassette as shown in FIGS. 10 and 11. The cassette comprises a body part 50 having a flat base formed with an upstanding peripheral wall 51 and with an upstanding core 52: the cassette further comprises a flat cover 53 which fits across the open top of the body part 50 and is secured in place by a screw 54 which passes through the cover 53 and into the core 52. The cassette comprises a generally circular main portion, with the core 52 at its center, from which a tapered portion projects: the end of the latter portion is provided with a slot 55. The feedstock 19 is wound around the core 52 within the cassette and its free end passes outwardly through the slot 55. The core 52 and fastening screw 54 are formed with a through-hole so that the cassette can be mounted on the spindle 32 of the printer, alongside one or more additional cassettes. In passing to the print head, the feedstock 10 is guided by the opposite sides of the cassette and so prevented from wandering sideways. As shown in FIG. 11, when the cassette is fitted into the printer, its tapered end terminates a short distance from the entrance to the passageway between the two guide plates 34: the cassette remains free to turn on the spindle 32, and to adopt its own position as the feedstock 19 is drawn past the print head.

It will be noted that the cassette is symmetrical in shape about a plane which contains the exit slot 55 and the axis of the core 52. Thus, its feedstock 10 can be printed on one side, then rewound into the cassette, and the cassette can then be turned over for the feedstock to be printed on its opposite side.

It will be appreciated that the printer can print any desired indicia on the feedstock: the printing may run either lengthwise or transversely of the feedstock. The printing may also include graphics. Further, the printing may be formed to any selected color, by appropriate choice of the materials used for the printer ribbon. The feedstock can be of any desired color, and the printing may be white (or other light colors) onto black (or other dark color) feedstock.

The printer may be adapted to accepted large-diameter reels of feedstock, carried on a spindle mounted outside the printer casing. The feedstock may then enter the printer through its rear wall, pass over the spindle 32 of the printer and then be guided by a pair of guide members 42 (as previously described) to the passageway between the guide plates 34.

The flattened tubing feedstock 19 of FIG. 1 may be preformed with its successive transverse lines of weakness 12 prior to printing, as shown: alternatively, these lines of weakness may be formed subsequent to the printing. Similarly, the strip 20 of FIG. 8 may be formed with its transverse lines of weakness 22 and fixing apertures 24 prior to printing, or subsequent to the printing. Alternatively, the feedstock (particularly the strip 20 of FIG. 8) may be supplied in its printed form, without its transverse lines of weakness, for the user to cut individual markers from it.

In embodiments where the strip or tubing is preformed with transverse lines of weakness defining successive markers, the lines of weakness may be overprinted with a band of transparent UV ink, in order to define datum marks.

Figure 12:
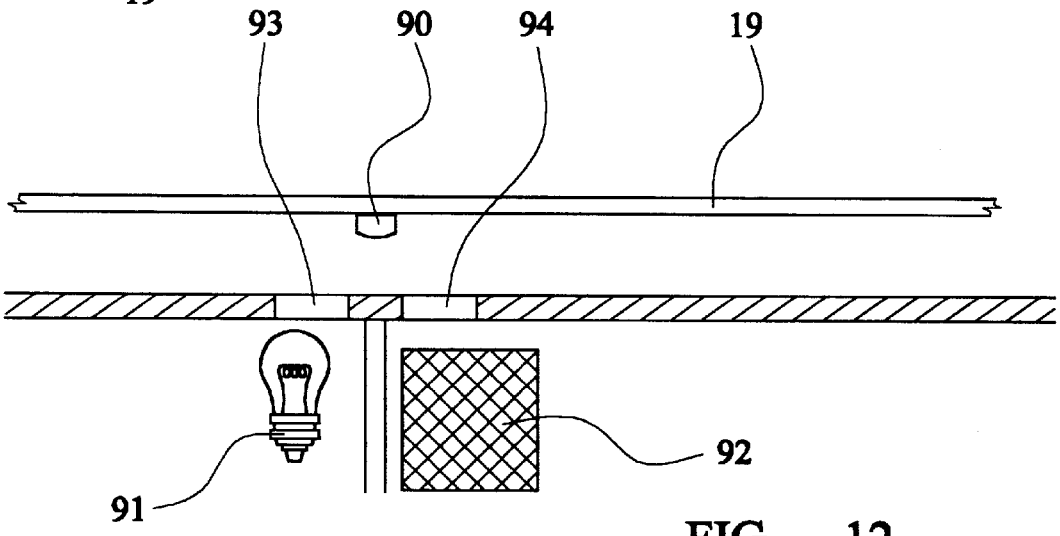
FIG. 12 is a schematic sectional view of a portion of an alternative embodiment of thermal transfer printer in accordance with the invention.

Referring to FIG. 12, the printer is arranged to detect datum marks between successive markers, so that it can determine where to form the prints on successive markers. In order to achieve this, the printer comprises a UV light source 91 which illuminates the strip or tubing 19 with UV light through a window 93. UV light is reflected from the strip or tubing 19 through a window 94 onto a UV sensor 92 disposed adjacent the light source 91.

The output of the sensor 92 is connected to a print control unit via a level detector. In use, a greater amount of UV light is reflected by the strip or tubing 10/20 when the datum marks 90 pass the sensor 92. The level detector is arranged to detect the increased output level of the sensor 92 and in this manner the print control circuit can control the position of successive prints to correspond with the position of the successive markers as the strip or tubing advances through the printer.

A particular advantage of using a thermal transfer printer is that the print formed on the feedstock is resistant to touch (in contrast to the print formed by dot matrix printers, which requires "fixing", for example under UV light). Further, the print is itself resistant to UV light, and will therefore not fade over time.

It will further be appreciated that the printer avoids wastage. The reels and cassettes can be re-used. Further, the feedstock is free of contamination: the reels of feedstock can be enclosed in a wrapper until use, whilst the cassettes are enclosed and ensure protection for the feedstock.

What is claimed is:

1. A method of printing onto a plastic substrate, the method comprising the steps of:

i) providing a print carrier carrying a unitary printing composition comprising first and second colorant materials; and ii) registering said print carrier against the substrate and applying heat and pressure thereto so as to transfer said printing composition, including both said first and said second colorant materials, in a single step to the substrate, said first colorant material being arranged to penetrate into the plastic substrate to form a substantially permanent mark below the surface of the substrate, and said second colorant material being arranged to adhere to the surface of the substrate overlaying the substantially permanent mark.

2. A method as claimed in claim 1, comprises advancing a length of elongate plastics strip or flattened tubing longitudinally of itself past the print carrier and printing indicia at successive longitudinal intervals onto said plastics strip or tubing.

3. A method as claimed in claim 1, comprising forming transverse lines of weakness in the plastics strip or tubing, after it has been printed.

4. A print carrier carrying a unitary releasable printing composition, said unitary printing composition comprising:

first and second colorant materials capable of being transferred in a single step to a plastic substrate upon application of heat and pressure to said print carrier when said print carrier is registered against the substrate, said first colorant material being arranged to penetrate into the plastic substrate to form a substantially permanent mark below the surface of the substrate, and said second colorant material being arranged to adhere to the surface of the substrate overlaying the substantially permanent mark.

5. A print carrier as claimed in claim 4, in which the second colorant material comprises a pigment and a plastics material capable of adhering to the plastics substrate, the first colorant material comprising a dye.

6. A print carrier as claimed in claim 5, in which the plastics material comprises a low molecular weight homopolymer PVC.

7. A print carrier as claimed in claim 5, in which the printing composition carried by the print carrier comprises the colorant materials bound in a releasing agent/matrix material.

8. A print carrier as claimed in claim 7, in which the releasing agent/matrix material comprises a high molecular weight material.

9. A print carrier as claimed in claim 7, in which the printing composition carried by the print carrier comprises:

i) 50–70% by weight, dye and pigment;

ii) 8–12% by weight plastics material for adhering with the substrate; and iii) 15–20% by weight, releasing agent/matrix material.

10. A print carrier as claimed in claim 4, wherein the first colorant material comprises a first dye (a solvent violet) based on N—tetra, N—penta, N—Lisea para-rosaniline hydrochlorides and a second dye (a solvent black) being an azo dye of formula $C_{29}H_{24}N_6$ chemical name 1 H—pyrimidine, 2,3-dihydro-2,2-dimethyl-6[(4-(phenylazo)-1-naphthyl)azo].

11. A print carrier as claimed in claim 4, wherein the second colorant material comprises an amorphous black inert solid pigment.

12. An assembly comprising a thermal transfer printer having a print carrier as claimed in claim 4, in combination with a plastics substrate, the printer also having a thermal transfer print head registering against the substrate, the print head being arranged to transfer said printing composition to the substrate by applying heat and pressure to the print carrier.

13. An assembly as claimed in claim 12, in which the printing composition carried by the print carrier comprises a plastics material of the same type as the plastics material of the plastics substrate.

14. An assembly as claimed in claim 12, in which the printing composition carried by the print carrier comprises a plastics material of the different type from the plastics material of the plastics substrate.

15. An assembly as claimed in claim 12, in which the plastics substrate comprises an elongate length of plastics strip or flattened tubing.

16. An assembly as claimed in claim 15, in which said elongate length of plastics strip or tubing is formed with transverse lines of weakness at intervals along its length to define successive markers.

17. An assembly as claimed in claim 16, in which datum markings are formed at regular intervals along the strip or tubing, the spacing between each marking being related to the length of each marker, the printer comprising a sensor arranged to sense the position of each marker as the strip or tubing is advanced through the printer and control means arranged to control the position at which successive prints are formed on successive markers of the strip or tubing, in accordance with the output of the sensor.

18. An assembly as claimed in claim 17, in which the markings are transparent.

19. A plastics printed marker as claimed in claim 16, in which said elongate length of plastics strip or tubing is formed with transverse lines of weakness at intervals along its length, said printed marks being carried between the adjacent pairs of lines of weakness.

20. A plastics printed marker as claimed in claim 15, comprising an elongate length of plastics strip or flattened tubing, having a series of marks printed at successive intervals along its length.

* * * * *